US007549933B2

(12) United States Patent
Kumamoto

(10) Patent No.: US 7,549,933 B2
(45) Date of Patent: Jun. 23, 2009

(54) GOLF CLUB HEAD

(75) Inventor: Tomio Kumamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 329 days.

(21) Appl. No.: 10/770,406

(22) Filed: Feb. 4, 2004

(65) Prior Publication Data

US 2005/0119070 A1 Jun. 2, 2005

(30) Foreign Application Priority Data

Feb. 14, 2003 (JP) ..... 2003-037026

(51) Int. Cl.
*A63B 53/04* (2006.01)

(52) U.S. Cl. ..... 473/329; 473/345; 473/348; 473/350

(58) Field of Classification Search ..... 473/324–350
See application file for complete search history.

(56) References Cited

U.S. PATENT DOCUMENTS

| | | | | |
|---|---|---|---|---|
| 1,269,745 | A * | 6/1918 | Robertson | 473/344 |
| 5,255,913 | A * | 10/1993 | Tsuchida | 473/329 |
| 5,350,556 | A * | 9/1994 | Abe et al. | 264/248 |
| 6,102,813 | A * | 8/2000 | Dill | 473/305 |
| 6,146,286 | A * | 11/2000 | Masuda | 473/305 |
| 6,332,847 | B2 * | 12/2001 | Murphy et al. | 473/324 |
| 6,354,963 | B1 * | 3/2002 | Kodama et al. | 473/345 |
| 6,575,845 | B2 * | 6/2003 | Galloway et al. | 473/329 |
| 6,623,378 | B2 * | 9/2003 | Beach et al. | 473/345 |
| 6,645,086 | B1 * | 11/2003 | Chen | 473/335 |
| 6,872,152 | B2 * | 3/2005 | Beach et al. | 473/324 |
| 6,932,875 | B2 * | 8/2005 | Cheng et al. | 148/522 |
| 6,984,181 | B2 * | 1/2006 | Hettinger et al. | 473/340 |
| 2002/0187853 | A1 * | 12/2002 | Beach et al. | 473/345 |
| 2007/0117648 | A1 * | 5/2007 | Yokota | 473/328 |

FOREIGN PATENT DOCUMENTS

| | | | |
|---|---|---|---|
| JP | 06190088 | A * | 7/1994 |
| JP | 09253242 | A * | 9/1997 |
| JP | 11137734 | A | 5/1999 |
| JP | 11169493 | A | 6/1999 |
| JP | 2001-190719 | A | 7/2001 |
| JP | 2004351173 | A * | 12/2004 |

* cited by examiner

*Primary Examiner*—Alvin A Hunter
(74) *Attorney, Agent, or Firm*—Birch Stewart Kolasch & Birch LLP

(57) ABSTRACT

A hollow golf club head having a face portion, a crown portion, a sole portion, a side portion and a hosel portion, comprises a metal component made of a metal material, and a resin component made of a fiber reinforced resin, wherein the metal component comprises a face plate forming at least a part of the face portion, and a sole plate forming at least a part of the sole portion, and the resin component comprises a crown plate forming at least a part of the crown portion. A tubular part of the hosel portion into which a club shaft is inserted is formed (a) integrally with the metal component or (b) separately from the metal component and the resin component.

22 Claims, 12 Drawing Sheets

GOLF CLUB HEAD

This Non-provisional application claims priority under 35 U.S.C. § 119(a) on Patent Application No. 2003-037026 filed in JAPAN on Feb. 14, 2003, the entire contents of which are hereby incorporated by reference.

BACKGROUND OF THE INVENTION

The present invention relates to a golf club head, more particularly to a combination structure of a metal component and a fiber reinforced resin component which can increase the design freedom to make it possible to optimize the position of the center of gravity and the like while improving the hitting sound.

Nowadays, the mainstream of structures for wood-type golf club heads is such that almost all of the components are made of metal materials, e.g. titanium alloy, stainless steel and the like. Usually, such all-metal structure produces high-pitched hitting sound which may give the impression that the hitting is successful and the traveling distance of ball is long, and thus, preferred by many golfers.

All-metal structures are however headache for the designers because design freedom is less, and it is difficult to optimize the weight distribution, the position of the center of gravity, etc., while increasing the head volume at the same time.

Thus, it is conceivable to make a head of FRP having a relatively low specific gravity. In case of the all-FRP head, however, the ball hitting sound is relatively heavy or dull and can not leave a favorable impression. Further, sometimes the rebound performance is pointed out as being inferior to the all-metal club heads.

SUMMARY OF THE INVENTION

It is therefore, an object of the present invention to provide a golf club head, in which the design freedom is increased, for example to make the center of gravity lower and deeper and the head volume larger at the same time, while achieving the favorable high-pitched hitting sound of the all-metal heads.

According to the present invention, a hollow golf club head having a face portion whose front face defines a club face for striking a ball, a crown portion, a sole portion, a side portion between the crown portion and sole portion and a hosel portion, comprises a metal component made of a metal material, and a resin component made of a fiber reinforced resin, wherein the metal component comprises a face plate forming at least a part of the face portion, and a sole plate forming at least a part of the sole portion, and the resin component comprises a crown plate forming at least a part of the crown portion. A tubular part of the hosel portion into which a club shaft is inserted can be formed (a) integrally with the metal component or (b) separately from the metal component and the resin component.

DESCRIPTION OF THE PREFERRED EMBODIMENTS

Figure 1:
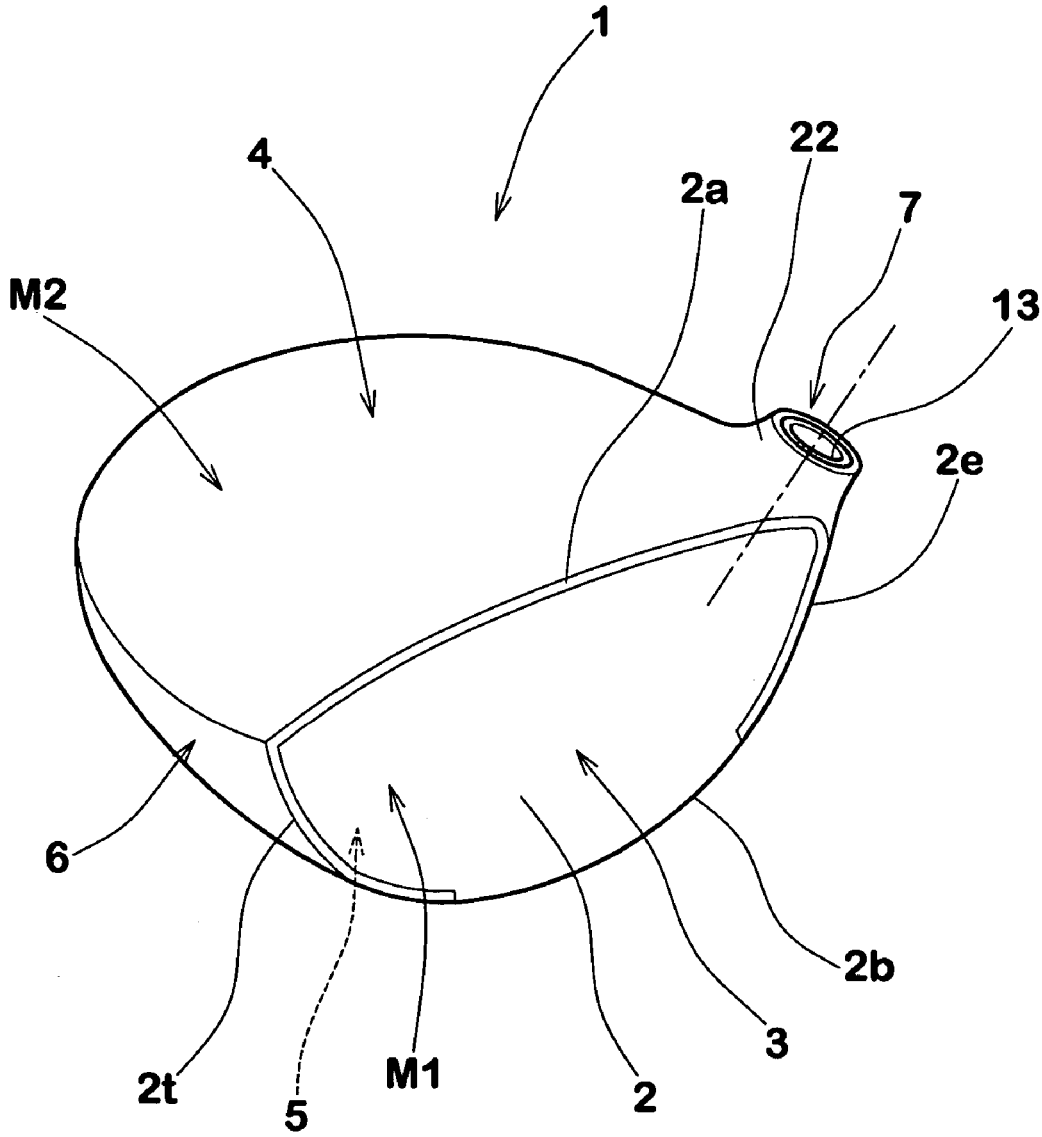
FIG. 1 is a perspective view of a wood-type golf club head according to the present invention.

Embodiments of the present invention will now be described in detail in conjunction with the accompanying drawings.

According to the present invention, a club head 1 is formed by combining a metal component M1 made of a metal material with a resin component M2 made of a fiber reinforced resin.

In the drawings, all the golf club heads 1 according to the present invention are wood-type hollow heads for driver (#1) or fairway wood, having a head volume of not less than 300 cc.

The head volume is preferably set in the range of more than 350 cc, more preferably more than 380 cc, still more preferably more than 400 cc, but not more than 600 cc, preferably less than 500 cc in order to improve not only hitting performance but also hitting sound because the hollow structure in such a relatively large head volume can lengthen the reverberation time of hitting sound.

Figure 2:
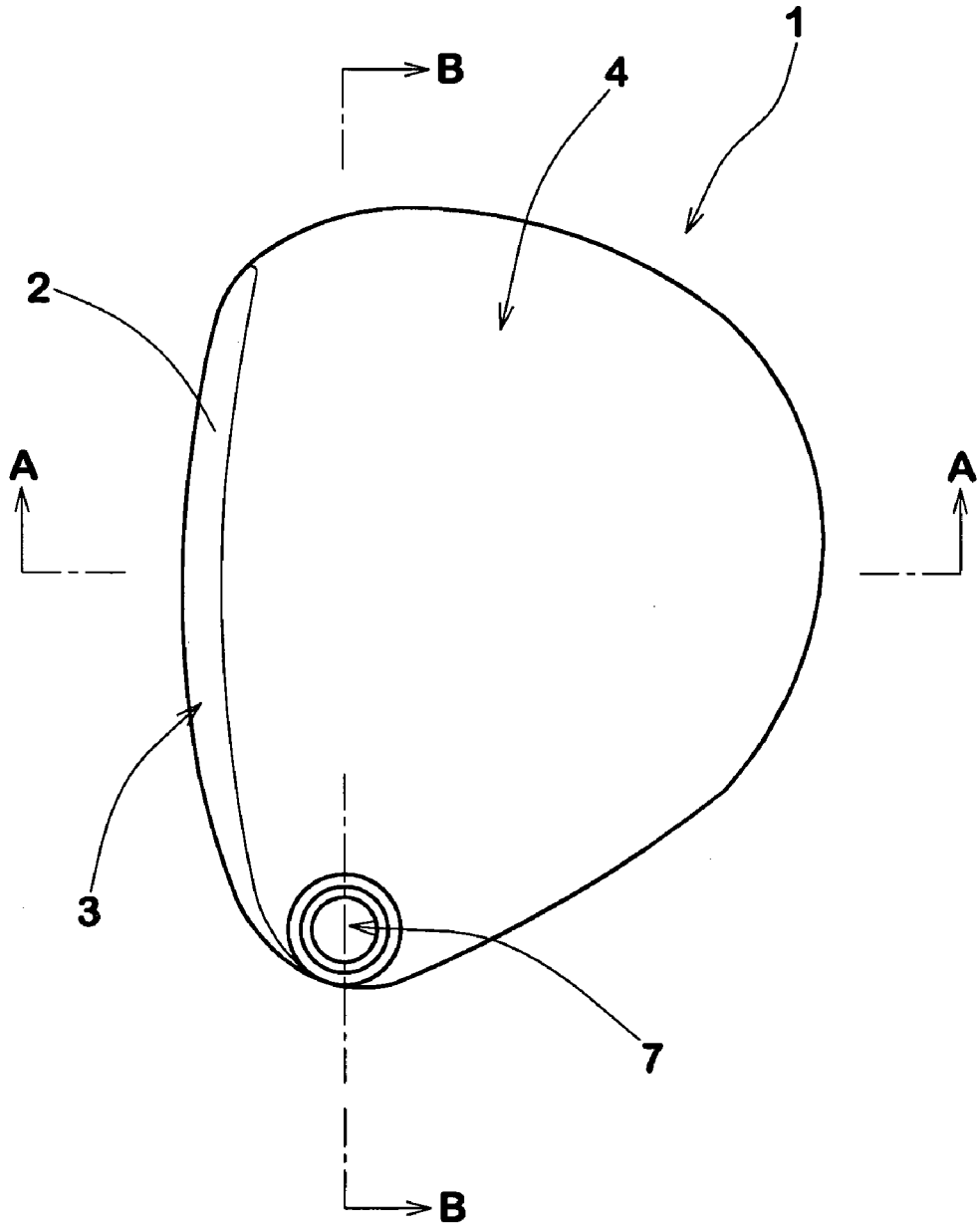
FIG. 2 is a top view thereof.
Figure 3:
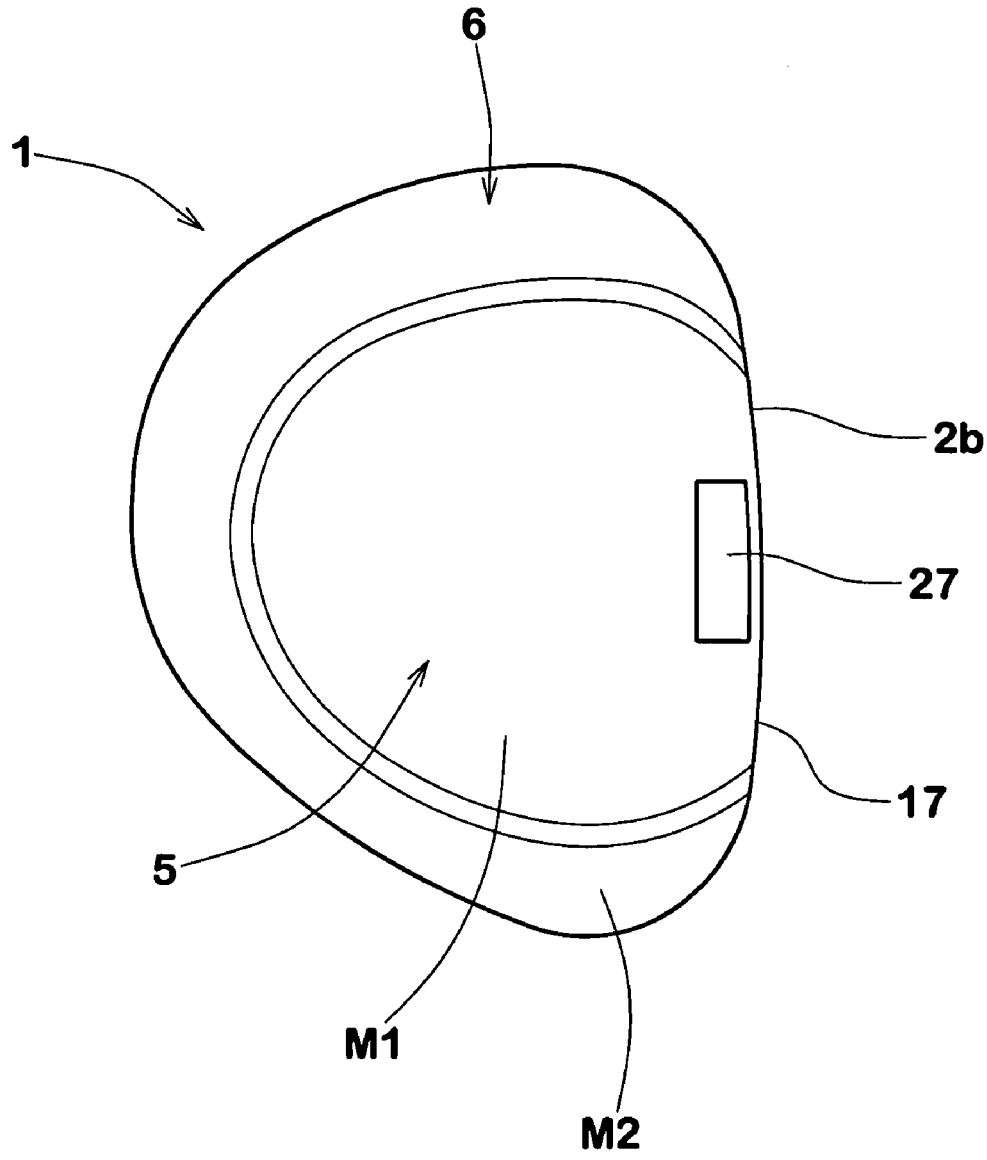
FIG. 3 is a bottom view thereof.

As shown in FIGS. 1, 2 and 3, the wood-type club head 1 comprises: a face portion 3 whose front face defines a club face 2 for striking a ball; a crown portion 4 intersecting the club face 2 at the upper edge 2*a* thereof; a sole portion 5 intersecting the club face 2 at the lower edge 2*b* thereof; a side portion 6 between the crown portion 4 and sole portion 5 which extends from a toe-side edge 2*t* to a heel-side edge 2*e* of the club face 2 through the back face of the club head; and a hosel portion 7 to be attached to an end of a club shaft (not shown). The hosel portion 7 comprises an upwardly protruding hosel neck 22 provided at the top with a circular hole 13 for inserting a club shaft, and a hosel tubular part 11 which extends into the inside (hollow) of the head and through which the shaft inserting hole 13 extends.

Metal Component M1

The metal component M1 comprises a face plate 9 defining at least a major part of the club face 2 inclusive of the centroid thereof, and a sole plate 10 extending backwards from the face plate 9. These plates are formed as a single-piece of a metal material.

In order to make the metal component M1, various metal materials such as titanium alloys, pure titanium, aluminum alloys and stainless steels may be used.

In this embodiment, a titanium alloy suitable for casting, for example, Ti-6Al-4V is used, and the metal component M1 is formed as a casting by a lost-wax precision casting method.

Preferably, the face plate 9 defines more than 80% of the club face 2 in area.

In the following examples, the face plate 9 is formed in a similar shape to that of the club face 2, and the face plate 9 defines the almost entirety of the club face 2.

With respect to the thickness of the face portion 3, it is preferable that the face portion 3 is provided with a thin annular peripheral zone because the mechanical impedance comes close to that of the ball, and the rebound performance may be improved. There is more, as the resultant thicker central region becomes small in size. Thus, the frequency of characteristic vibration becomes higher, which contributes to the improvement in the hitting sound.

Therefore, in the face plate 9, in comparison with the central region 9*a* including the centroid of the club face 2 or sweet spot SS, the thickness is reduced in a peripheral region 9*b*. The thickness Tc in the central region 9*a* is set in a range of not less than 2.5 mm, preferably more than 2.7 mm, but not more than 3.0 mm, preferably less than 2.9 mm.

The thickness Tp in the peripheral region 9*b* is set in a range of not less than 2.0 mm, preferably more than 2.3 mm, but not more than 2.5 mm.

It is preferable that the thin peripheral region 9*b* has a width w such that the area of the peripheral region 9*b* becomes within the range of from 20 to 50% of the area of the central region 9*a*. Although such a variable thickness is preferred, it is still possible to use a substantially constant thickness.

The sole plate 10 is a substantially flat plate extending backwards from the lower edge of the face plate 9 and forms at least a major part of the sole portion 5. Preferably, the sole plate 10 defines more than 80% of the sole portion 5 in area. In the following examples, the sole plate 10 defines the almost entirety of the sole portion 5.

Preferably, the thickness of the sole plate 10 is gradually increased towards the rear end to make the center of gravity of the head deeper and lower.

In order to decrease the bending rigidity of the metal component M1 between the face plate 9 and sole plate 10 and thereby to match the rigidity at the upper edge bonded to the resin component M2, it is possible to form at least one slot 19 immediately behind the face plate 9 or in the front end of the sole plate 10.

In the illustrated examples, the slot 19 is a rectangle being long sideways. But, various shapes for example a semiellipse having a straight side aligned with the front end of the sole plate 10, an ellipse or similar round shape being long sideways or the like may be employed.

If the total length of the slot 19 along the bent line 17 between the face plate 9 and sole plate 10 is too long, the durability of the metal component M1 at the bent line 17 is liable to deteriorate. Thus, the total length of the slot(s) 19 is preferably set in the range of not less than 5%, preferably more than 15%, but not more than 70%, preferably less than 60% of the overall length of the bent line 17.

As to the width of the slot, on the other hand, it may be set at a considerably small value, for example, 1 mm or 0.5 mm in view of the purpose explained above.

In the finished head, the slot 19 is closed by a lid 27 made of a fiber reinforced resin same as or similar to the resin component M2 or an elastomer if the width is relatively wide. If narrow, it can be closed by applying resin putty, adhesive or the like. The slot 19 also has a merit such that the face plate 9 becomes liable to lean back at impact by its elastic deformation. Thus, the loft angle is increased dynamically to increase the launching angle of the ball.

Resin Component M2

The resin component M2 comprises a crown plate 20 defining at least a major part (in this embodiment, the entirety) of the crown portion 4, and a side plate 21 extending downwards from the edge of the crown plate 20 to define at least a major part (in this embodiment, the entirety) of the side portion 6.

The resin component M2 is provided with an opening accommodated to the metal component M1. Thus, the opening ranges from the face portion 3 to the sole portion 5 forming a front opening O1 and bottom opening O2.

In order to support the edge portion of the metal component M1, a flange 24, 25 is continuously formed along the edge of the opening O1, O2. The width of the flange is set to be less than the width w of the above-mentioned peripheral region 9*b*.

The resin component M2 is formed as a single-piece of a fiber reinforced resin.

As to the reinforcing fibers, in order to make the minimum thickness as thin as possible, there are used high modulus fibers having a tensile modulus of elasticity of not less than 230 GPa, preferably not less than 300 GPa, more preferably not less than 390 GPa. To be specific, carbon fibers having a tensile modulus of elasticity of not less than 290 GPa, preferably not less than 390 GPa are suitably used. For example, the following can be used.

| | | Tensile modulus of elasticity | |
|---|---|---|---|
| Manufacturer | Symbol | ton/sq. mm | GPa |
| Mitsubishi Rayon Co., Ltd. | TR50S | 24.5 | 240.3 |
| Mitsubishi Rayon Co., Ltd. | MR40 | 30 | 294.2 |
| Mitsubishi Rayon Co., Ltd. | HR40 | 40 | 392.3 |
| Toray Industries, Inc. | T700S | 23.5 | 230.5 |
| Toray Industries, Inc. | T300 | 23.5 | 230.5 |
| Toray Industries, Inc. | T800H | 30 | 294.2 |
| Toray Industries, Inc. | M30SC | 30 | 294.2 |
| Toray Industries, Inc. | M40J | 38.5 | 377.6 |
| Toray Industries, Inc. | M46J | 46 | 451.1 |
| TOHO TENAX Co., Ltd. | UT500 | 24.5 | 240.3 |
| TOHO TENAX Co., Ltd. | HTA | 24 | 235.4 |
| TOHO TENAX Co., Ltd. | IM400 | 30 | 294.2 |
| Nippon Graphite Fiber Corporation | YS-80 | 80 | 784.5 |

Here, the tensile modulus of elasticity is measured according to Japanese Industrial standard R7601, 1986.

A combination of such high modulus fibers and a thermosetting resin is suitably used as the fiber reinforced resin.

As to the thermosetting resin, various resins such as epoxy resin, polyester resin, phenol resin, urea resin, melamine resin, polyurethane resin, silicone, and diallyl phthalate may be used.

In this embodiment, prepregs made of such materials is used to make the resin component M2. Thus, the fiber reinforced resin is a laminate of prepregs. Incidentally, a prepreg is a thin material formed by impregnating fibers with a thermosetting resin.

As to the orientation of the fibers in the prepreg, unidirectional orientation (unwoven fabric) or bidirectional orientation (square woven fabric) is used.

In the finished head, it is preferable that the fibers are oriented two or more directions to form a cross fiber arrangement. It is however, also possible to employ random orientation.

Figure 4:
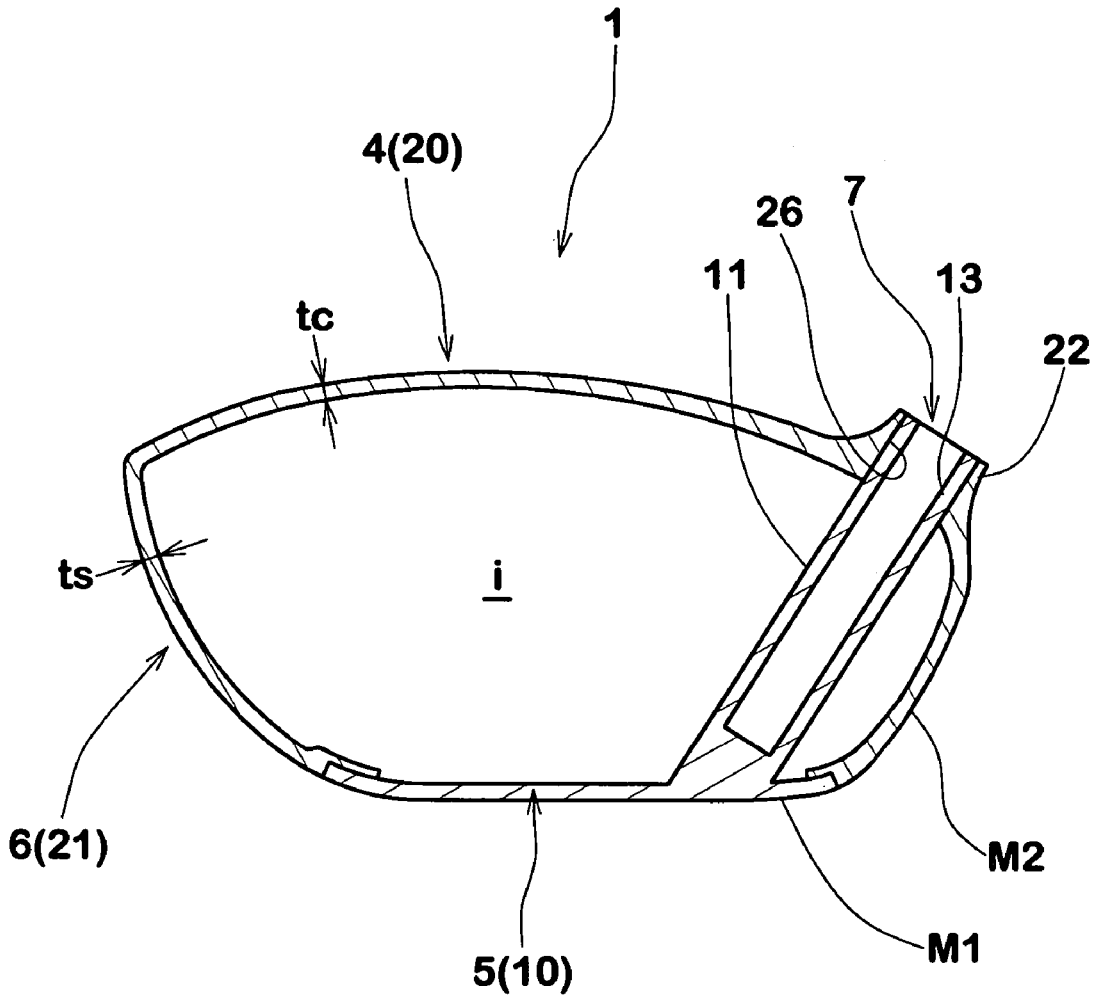
FIG. 4 is a cross sectional view taken along a line B-B in FIG. 2 showing an embodiment of the present invention wherein the hosel is formed integrally with the metal component.
Figure 5:
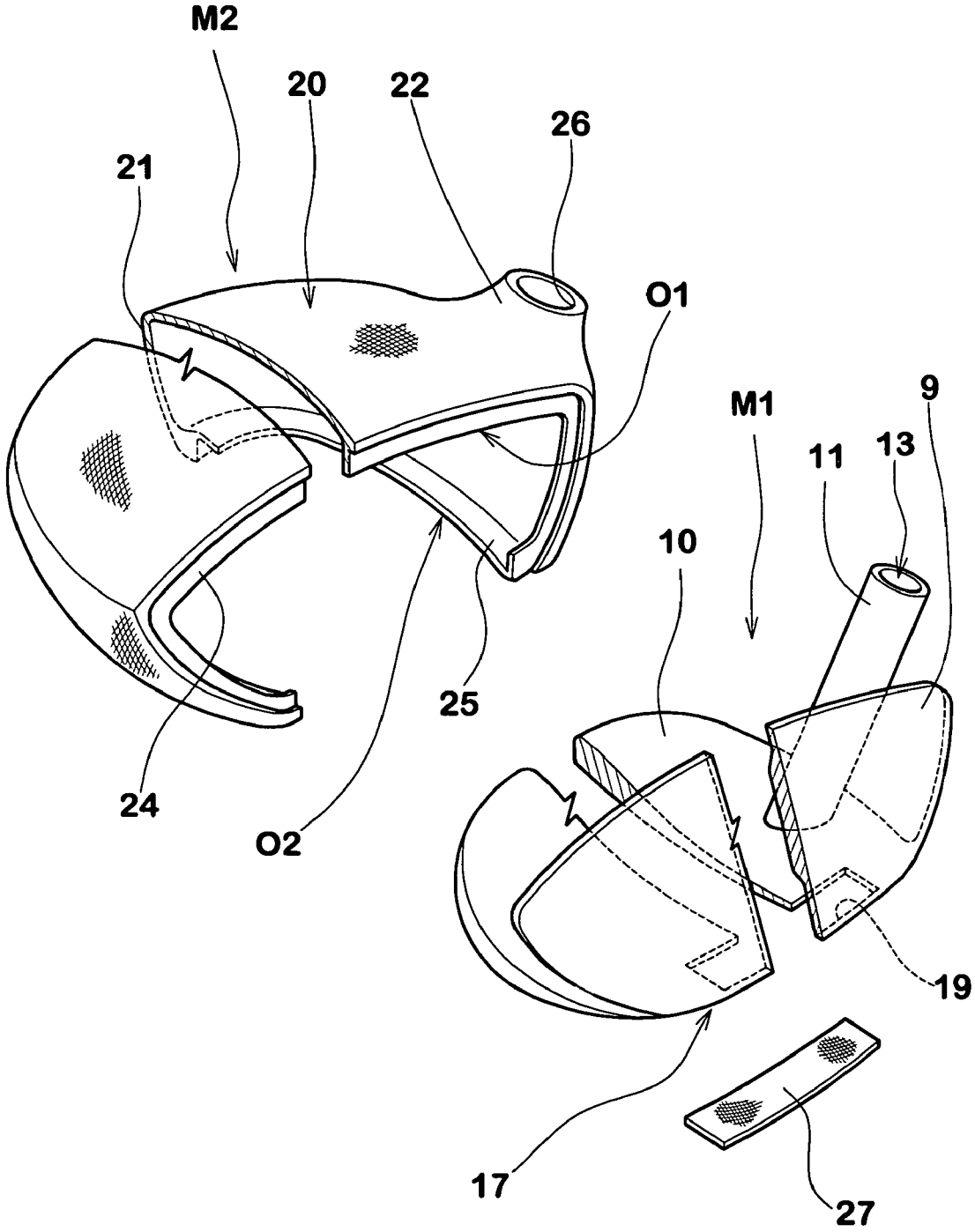
FIG. 5 is an exploded perspective view thereof.

FIGS. 4 and 5 show an embodiment wherein the hosel tubular part 11 is formed integrally with the metal component M1.

Figure 6:
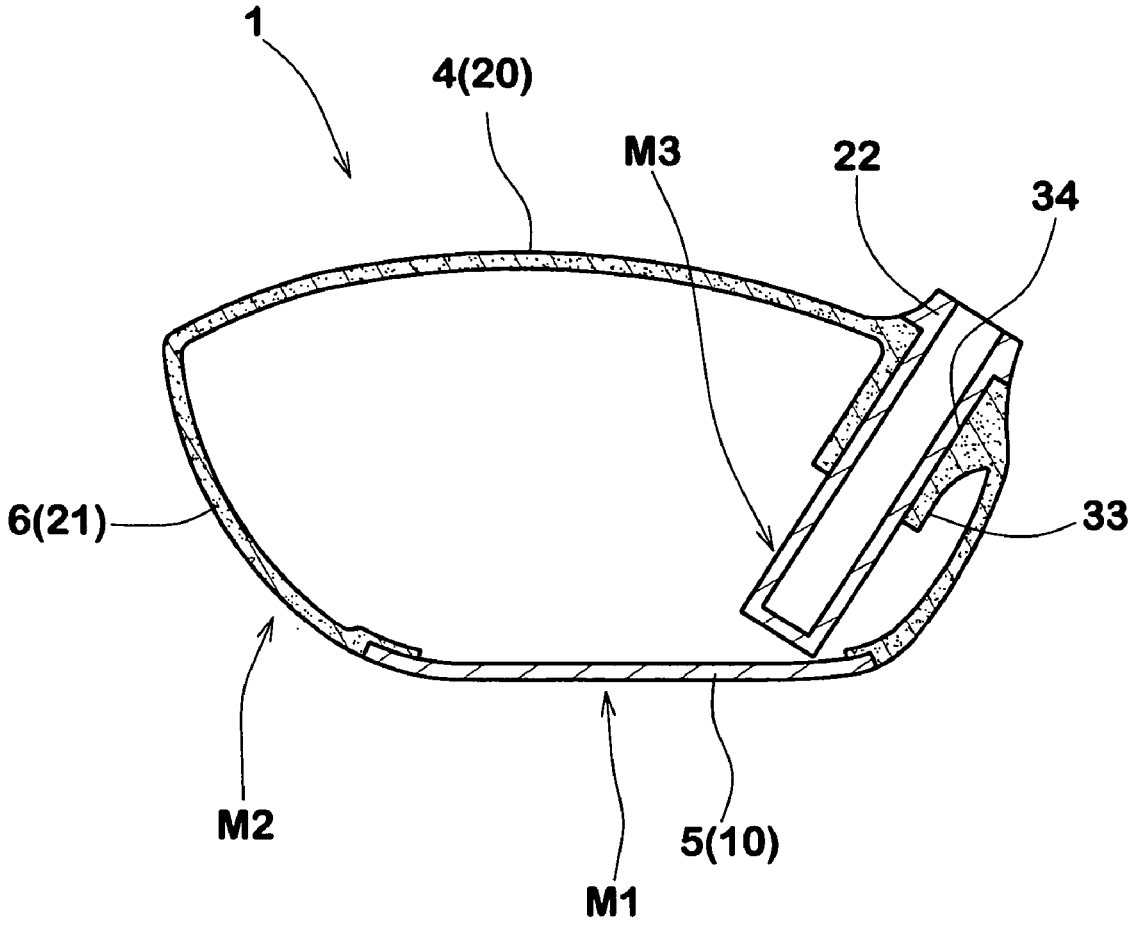
FIG. 6 is a cross sectional view taken along a line B-B in FIG. 2 showing another embodiment of the present invention wherein the hosel is formed separately from the metal component and resin component.
Figure 7:
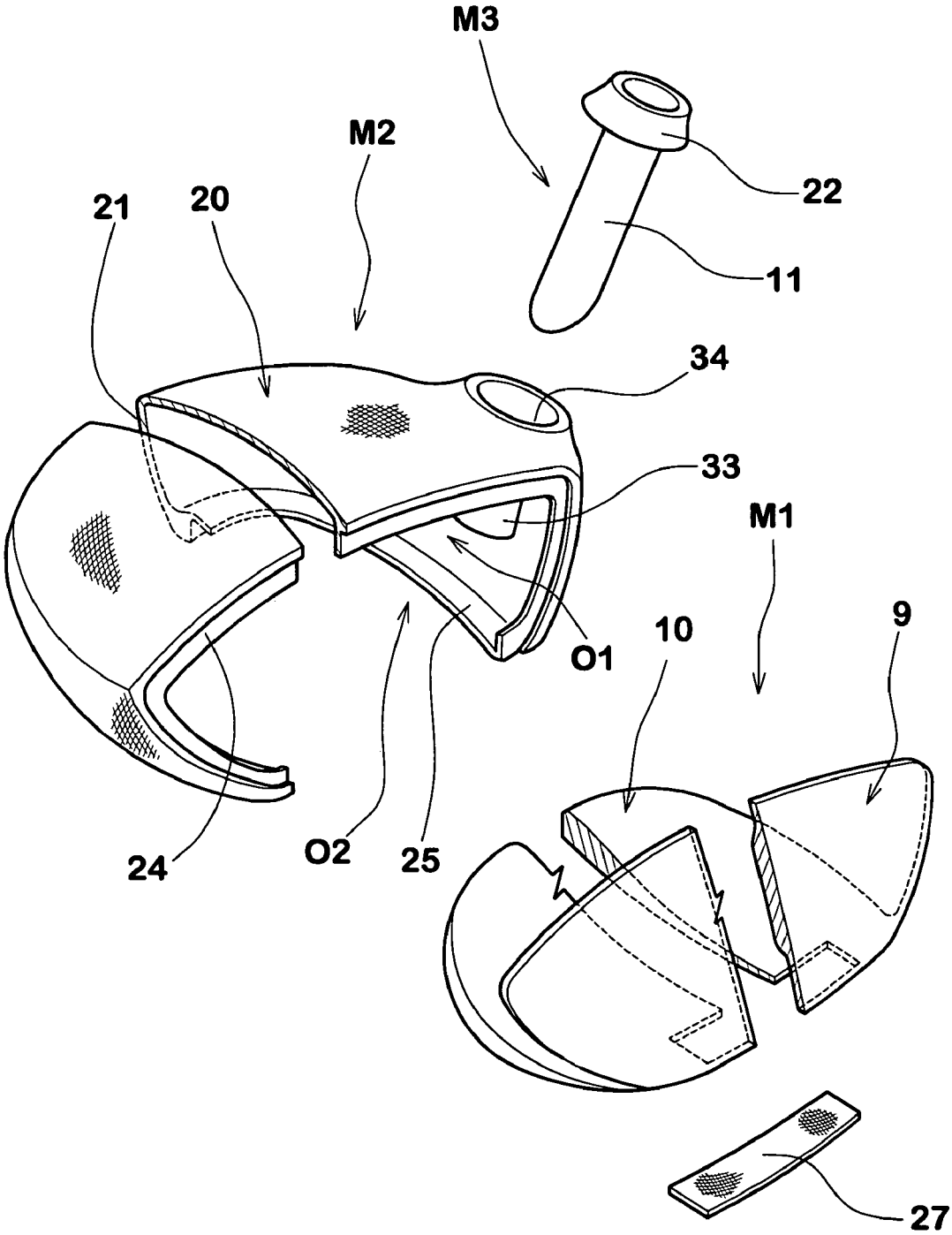
FIG. 7 is an exploded perspective view thereof.

FIGS. 6 and 7 show another embodiment wherein the hosel tubular part 11 and hosel neck 22 are formed as a single-piece part M3 (hereinafter, "hosel component M3") separately from the metal component M1 and resin component M2.

In FIGS. 4 and 5, the hosel tubular part 11 extends aslant from the sole plate 10 and has a substantially constant diameter from the lower end to the upper end. Preferably, such metal component M1 is made by casting. But, it is also possible to form the metal component M1 by forging, press working, rolling, lathing, shaving and the like. Basically, the metal component M1 including the hosel tubular part 11 is a single-piece. But, it may be possible to combine two or more separate pieces into the metal component M1.

On the other hand, the hosel neck 22 is formed integrally with the resin component M2. Thus, the hosel neck 22 is made of the fiber reinforced resin. In this embodiment, thus, the resin component M2 is made up of the above-mentioned crown plate 20 defining the entirety of the crown portion 4, the side plate 21 defining the entirety of the side portion 6, and-the hosel neck 22. The hosel neck 22 is provided with a hole 26 into which the upper end of the hosel tubular part 11 is inserted. This supporting hole 26 has an inside diameter almost same as the outside diameter of the upper end of the hosel tubular part 11, and they are fixed using an adhesive agent.

In FIGS. 6 and 7, the hosel component M3 made up of the hosel tubular part 11 and hosel neck 22 is made of a metal material, e.g. aluminum alloy. The metal component M1 is the same as the former example, excepting that the hosel tubular part 11 is not included. The resin component M2 is integrally provided with a tubular portion 33 protruding into the hollow, of which through hole forms a socket 34 for the hosel component M3. Using an adhesive agent, the hosel component M3 is fixed to the resin component M2.

Figure 8:
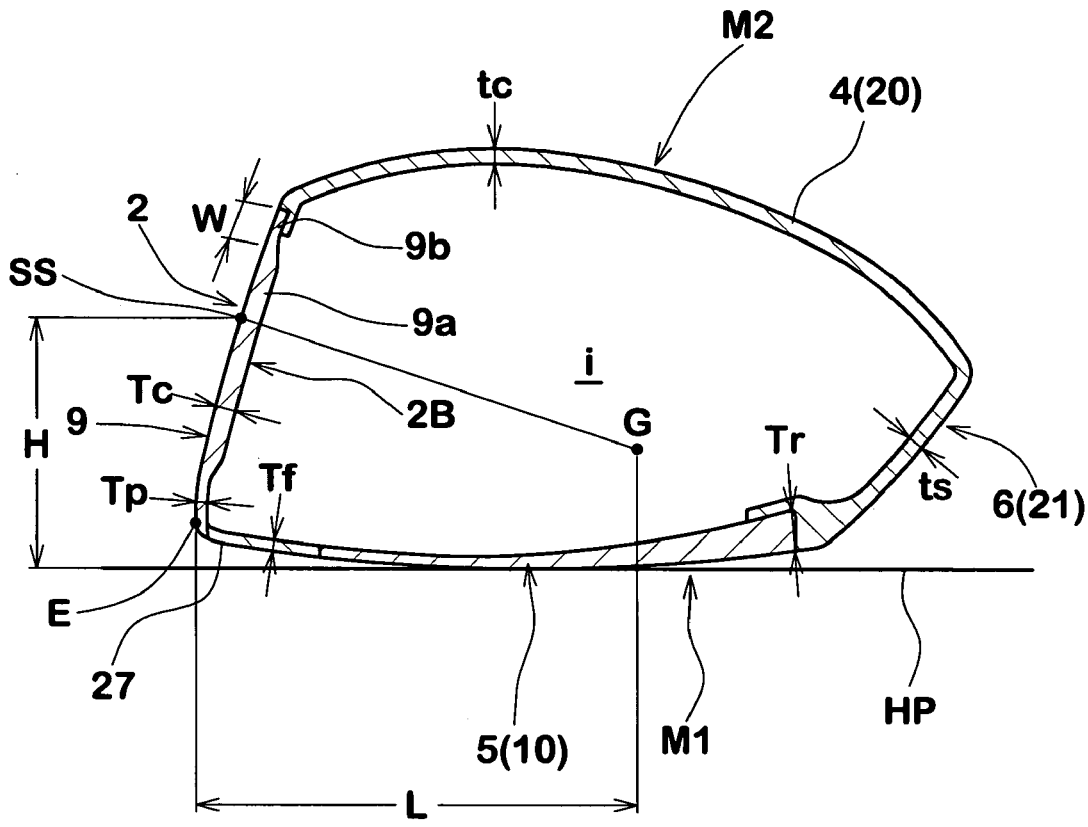
FIG. 8 is a cross sectional view taken along a line B-B in FIG. 2 showing an example of the thickness distribution of the club head.

In the examples of the metal component M1 shown in FIGS. 5 and 7, the thickness of the sole plate 10 is progressively increased to the rear end from a position halfway between the front end and rear end as shown in FIG. 8.

Figure 9:
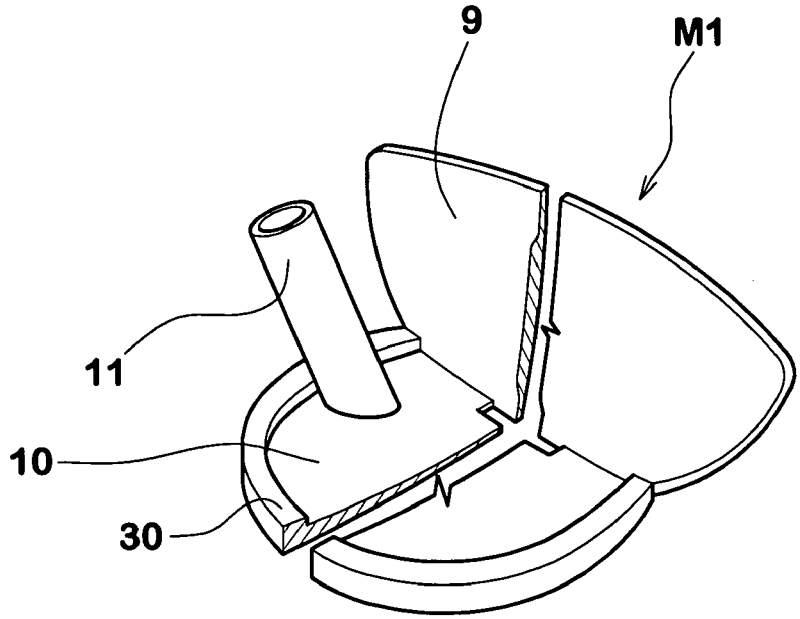
FIGS. 9, 10, 11, 12 and 13 are perspective views each showing another example of the metal component.

FIG. 9 shows another example of the metal component M1, wherein a rib 30 defining the maximum thickness is continuously formed on the fringe of the sole plate 10 excluding the front edge.

Figure 10:
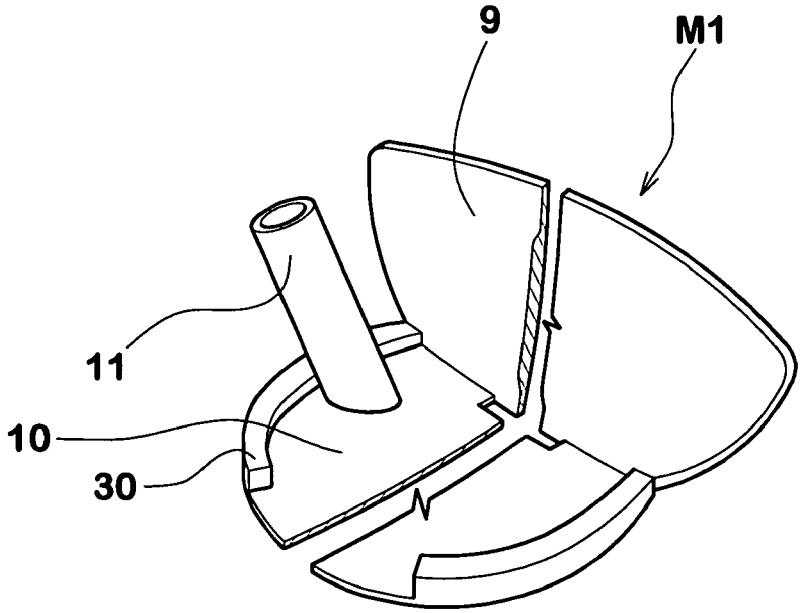

FIG. 10 shows a modification of the example shown in FIG. 9, wherein the rib 30 breaks at the rear edge.

By providing such a rib 30, it becomes possible not only to make the center of gravity deeper but also to increase the moment of inertia around the center of gravity.

Figure 11:
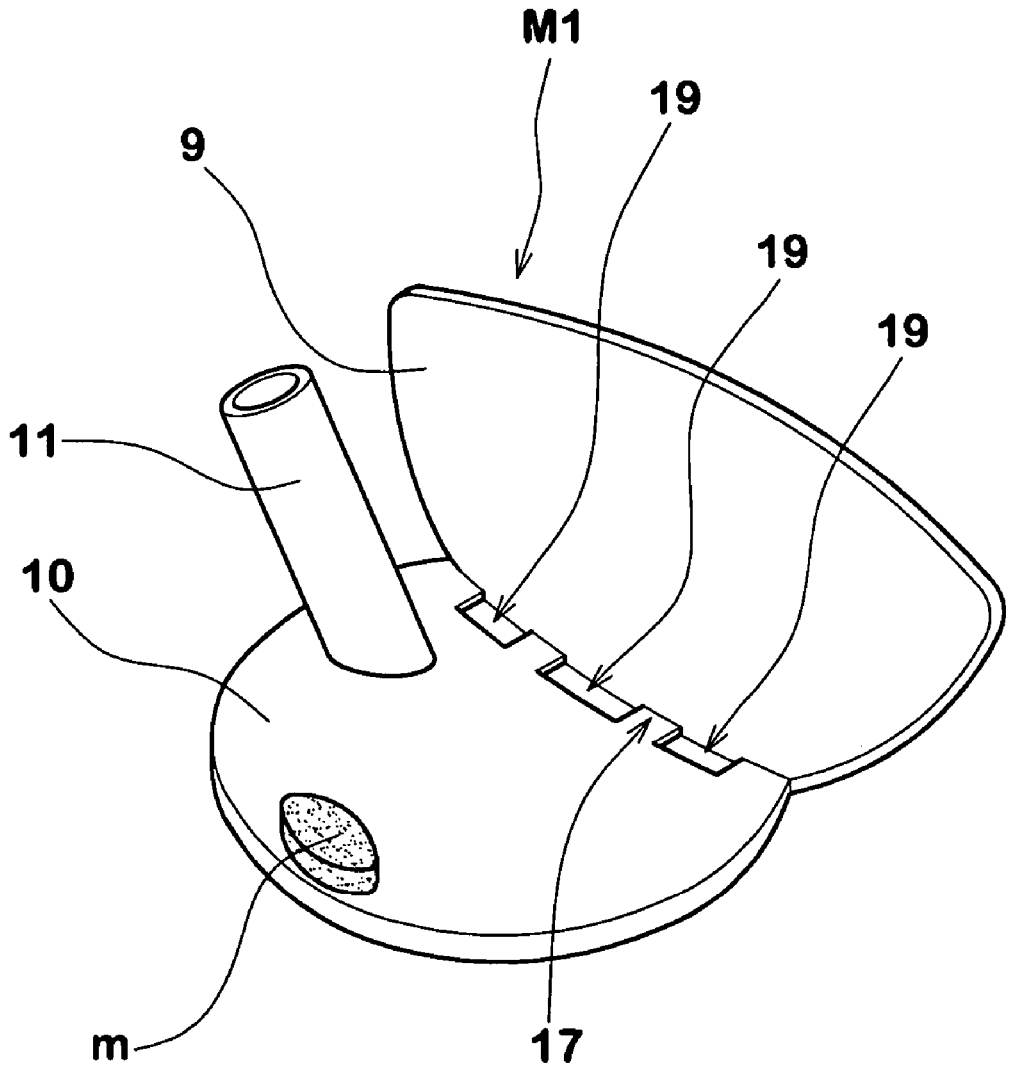

FIG. 11 shows a modification of the example shown in FIG. 5, wherein a weight (m) made of a heavy metal material such as tungsten having a relatively high specific gravity is disposed on the sole plate 10 near the rear end.

Figure 12:
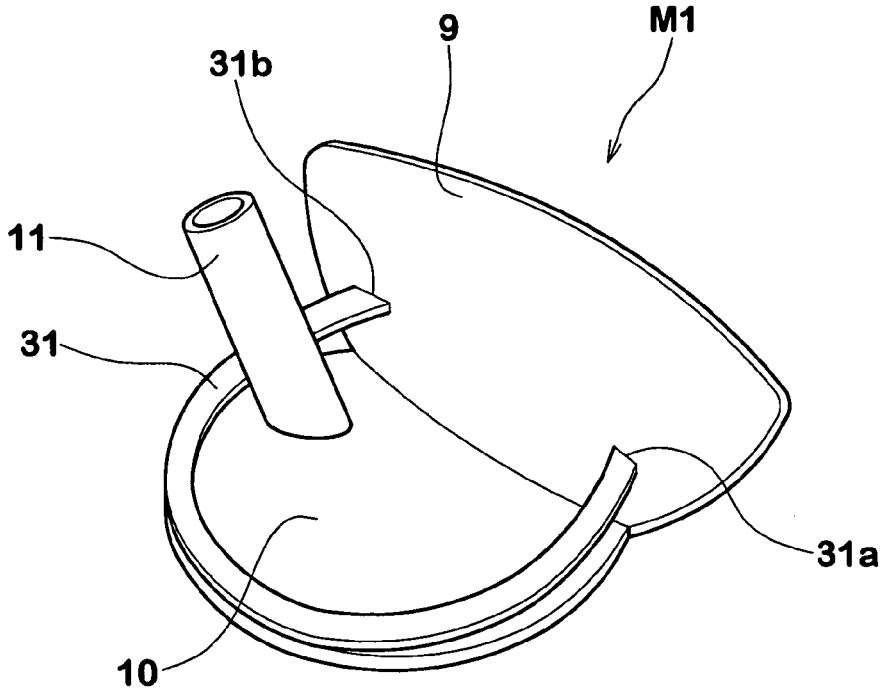

FIG. 12 shows a modification of the example shown in FIG. 5, wherein the metal component M1 is provided between the face plate 9 and sole plate 10 with a metal frame 31 for supporting the backside of the face plate 9. In order to reinforce the thin side plate 21 made of the resin as well as the face plate 9, the frame 31 in this example is formed in a shape like a horseshoe along the inside of the side portion 6. Thus, the metal frame 31 also improves the position of the center of gravity and moment of inertia. The two ends 31*a* and 31*b* thereof are fixed to the backside of the face plate 9 at the middle height of the club face near the toe-side edge and heel-side edge. And the middle part thereof is fixed to the upper surface of the sole plate 10 near the rear edge. The metal frame 31 may be formed as a separate part and fixed (for example, welded) to the metal component M1. But, the metal frame 31 is preferably formed integrally with the face plate 9 and sole plate 10 by casting or the like.

In any case, the maximum thickness Tr of the sole plate 10 at the rear end is preferably set in the range of not less than 2.0 mm, more preferably more than 2.5 mm, but not more than 8.0 mm, more preferably less than 6.0 mm.

Further, the minimum thickness Tf in the front end zone of the sole plate 10 is set in the range of not less than 1.0 mm, preferably more than 1.5 mm, but not more than 3.0 mm, preferably less than 2.5 mm.

Figure 13:
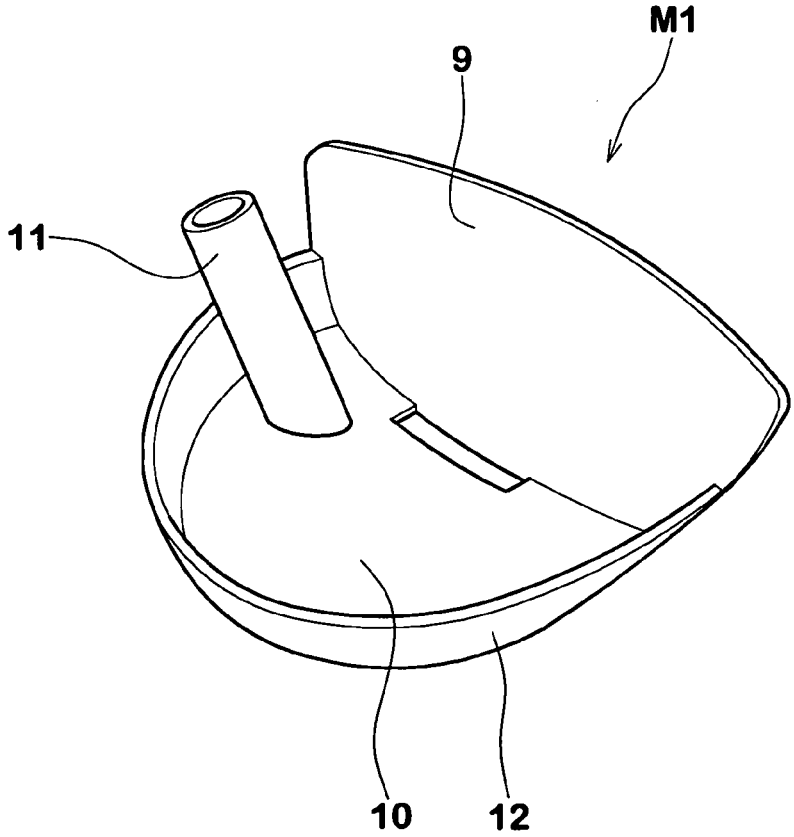

In the above-mentioned examples of the metal component M1 shown in FIGS. 5, 7, 9, 10, 11 and 12, the sole plate 10 is almost flat. But, it is possible to make a turnup 12 to form a lower region of the side portion 6 as shown in FIG. 13. The turnup 12 may be formed continuously as shown in FIG. 13 or discontinuously (not shown). In this case, of course, the side plate 21 of the resin component M2 (not shown) is reduced accordingly.

In the above-mentioned examples of the metal component M1 shown in FIGS. 9, 10, 11, 12 and 13, the hosel tubular part 11 is integrally included. But, these example can be modified by omitting the hosel tubular part 11 like the example shown in FIG. 7 in order to combine a resin component M2 as shown in FIG. 7.

Figure 14A:
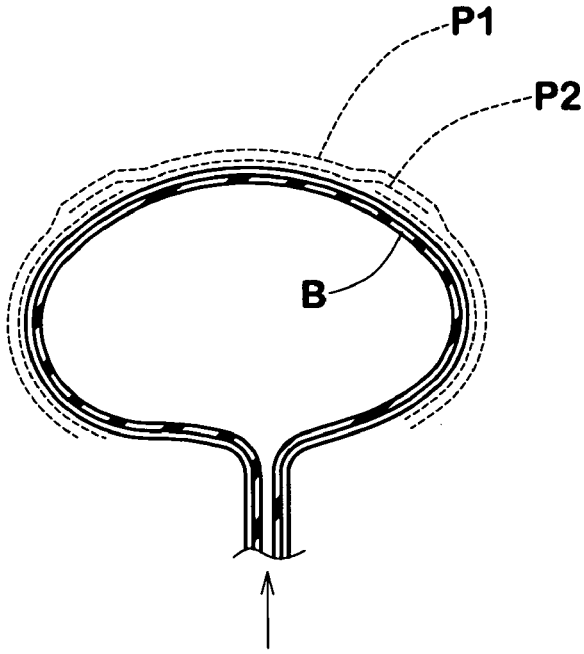
FIGS. 14*a* and 14*b* are schematic cross sectional views for explaining a method of manufacturing the resin component.
Figure 14B:
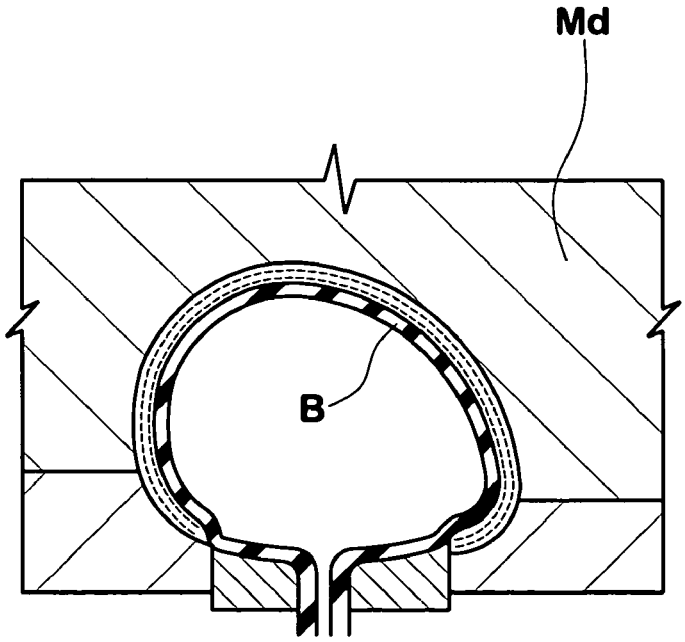

In order to make the resin component M2, various methods may be employed. But, as shown in FIGS. 14*a* and 14*b*, a prepreg molding method using a mold and prepreg as follows is preferred. As shown in FIG. 14*a*, unidirectional and/or woven prepregs P1, P2 - - - are applied on the outer surface of a substantially inflated bladder B. Then, the laminate is, as shown in FIG. 14*b*, put in a mold Md together with the bladder B. And the laminate is heated to harden the resin while applying high pressure to the inside of the bladder B. In this method, the thickness can be easily controlled by changing the number of prepregs laminated. Also the rigidity can be easily controlled by changing the fiber orientation or fiber crossing angle.

Aside from such prepreg molding, of course, other manufacturing methods such as injection molding may be employed. In this case, by mixing short fibers with the injected resinous material, random orientation may be obtained. If the fibers are disposed in the mold in advance, an ordered fiber arrangement may be obtained.

The resin component M2 and the metal component M1 are fixed to each other, using an adhesive agent. To be specific, the peripheral part of the face plate 9 is bonded to the flange 24 of the front opening O1, and the peripheral part of the sole plate 10 is bonded to the flange 25 of the bottom opening O2. For example, epoxide resin adhesives, rubber-based adhesives are preferably used, but various adhesive agents may be used depending on their materials.

In any case, the minimum thickness of the resin component M2 is set to be not less than 0.3 mm to secure minimum strength and durability.

If the thickness tc of the crown plate 20 is more than 2.0 mm, the crown plate 20 becomes difficult to vibrate at high frequency at impact, and further, it leads to heightening of the center of gravity. Thus, the thickness tc is set in the range of not more than 2.0 mm, preferably less than 1.5 mm, but not less than 0.3 mm, preferably more than 0.5 mm, more preferably more than 1.0 mm.

If the thickness ts of the side plate 21 is more than 8.0 mm, it becomes difficult to lower the center of gravity. Further, there is a tendency to hinder and damp or absorb the high-frequency vibration of the crown plate 20. Thus, the thickness ts is set in the range of not more than 8.0 mm, preferably less than 5.0 mm, but not less than 0.3 mm, preferably more than 1.0 mm.

As the thickness of the crown portion is decreased by reinforcing with high modulus fibers, not only the crown portion but also the face portion become easy to vibrate, and as a result the power spectrum of the hitting sound shifts towards the higher frequency.

In relation to the size of the resin component M2, the surface area S2 of the resin component M2 is set in the range of not less than 40%, preferably more than 50%, but not more than 70%, preferably less than 60% of the gross surface area of the club head 1.

When the head volume is more than 380 cc, in order to realize an ideal ballistic course by widening the sweet area and enhancing the vertical gear effect to reduce ball spin, it is preferable that the depth L of the center G of gravity is set in the range of from 40 to 55 mm, and the sweet spot height H is set in the range of from 15 to 30 mm.

Here, the depth L of the center G of gravity is the horizontal distance between the center G of gravity and the leading edge E as shown in FIG. 8, and the sweet spot height H is the height from the horizontal plane HP to the sweet spot SS which is the intersecting point of a normal line to the club face 2 drawn from the center G of gravity with the club face 2, both measured under the measuring state where the head 1 is set on the horizontal plane HP with its lie angle and hook angle.

Anyways, the hitting sound is arranged such that the maximum sound pressure level lies in the range of not less than 4000 Hz, preferably more than 4500 Hz, but not more than 7000 Hz, preferably less than 6000 Hz. The coefficient of restitution of the club head is set to be not less than 0.800, preferably more than 0.820, but not more than 0.860, preferably less than 0.850. Here, the coefficient of restitution is measured according to the "Procedure for Measuring the velocity Ratio of a club Head for conformance to Rule 4-1e, Appendix II, Revision 2 (Feb. 8, 1999), United states Golf Association".

In addition, when the ball hits the face plate 9, although the edge of the metal component M1 is bonded to the resin component M2, as the resin component M2 is thin and relatively flexible, the metal component M1 which is bent at 90 degrees or less acts like a tuning fork, which can contributes to enhance the high-pitched hitting sound and the reverberation time. In view of this effect, the examples shown in FIGS. 5, 7, 9, 10 and 11 are preferred rather than FIGS. 12 and 13.

Comparison Tests

Wood-type golf club heads having the same shape shown in FIG. 1 and specifications shown in Table 1 were made, and the following comparison tests were conducted.

In Ex.1-Ex.6: The metal component M1 having a basic structure as shown in FIG. 5 was formed as a lost-wax precision casting of a titanium alloy Ti-6Al-4V. The thickness was as follows: In-Face plate 9, Tc=2.8 mm, Tp=2.4 mm. In sole plate 10, Tf=1.5 mm, Tr=2.5 mm. The peripheral region 9*b* was 33% of the central region 9*a* in area. The resin component was formed by using prepregs and a mold as explained above. As to the carbon fibers, "TR50S", "MR40" and "HR40" manufactured by Mitsubishi Rayon Co., Ltd. were used in combination. The thickness was as follows: In crown plate 20, tc=0.4 mm. In side plate 21, ts=1.0 mm. The metal component M1 and resin component M2 were joined with an epoxide resin adhesive. In Ref.3: The hollow (i) was filled with an expanded plastic, otherwise the same as above. In Ref.2: The entirety was made of a carbon fiber reinforced resin. In Ref.1: The entirety was made of a titanium alloy Ti-6Al-4V.

Traveling Distance Test

The club heads were each attached to an identical carbon shaft to make a 46-inch driver. The club was mounted on a swing robot, and struck golf balls ("Maxfli Hi-Brid"™, manufactured by Sumitomo Rubber Industry, Ltd.) five times at the head speed of 45 meter/second, and the traveling distance (carry+run) of the ball was measured to obtain the average distance. The results are indicated by an index based on Ref.1 being 100. The larger the index number, the longer the traveling distance.

Rebound Performance Test

According to the "Procedure for Measuring the velocity Ratio of a club Head for conformance to Rule 4-1e, Appendix II, Revision 2(Feb. 8, 1999), United states Golf Association", the restitution coefficient (e) of each club head was obtained. The results are shown in Table 1. The larger the value, the better the rebound performance.

Hitting Sound Feeling Test

Using the above-mentioned clubs, fifty golfers whose handicaps ranged from 15 to 25 hit the golf balls and evaluated the hitting sound into five ranks from a point of view of tone pitch. The results are shown in Table 1. The higher the rank number, the higher the frequency.

Hitting Sound Frequency Analysis Test

Using the swing robot, the above-mentioned golf balls were hit by the head at the sweet spot at a head speed of 40 m/s, and the hitting sound was picked up with a microphone fixed at a position 80 cm forward and 160 cm upward of the ball hitting position, and a ⅓-octave-band frequency analysis was made. From the respective sound pressure levels of the ⅓-octave-bands measured, the highest level through the tenth highest level were selected out, and the mean value of the center frequencies of the selected ten bands was worked out. The hitting sound was measured five times per a head and the mean value was worked out at each time. In Table 1, the average of the five mean values is shown. The larger the value, the higher the hitting sound.

TABLE 1

| | Ref. 1 | Ref. 2 | Ref. 3 | Ex. 1 | Ex. 2 | Ex. 3 | Ex. 4 | Ex. 5 | Ex. 6 |
|---|---|---|---|---|---|---|---|---|---|
| Head | | | | | | | | | |
| Head volume (cc) | 380 | 380 | 380 | 380 | 380 | 380 | 360 | 400 | 400 |
| Structure | all titanium *1 | all FRP *2 | FIG. 5 *2 | FIG. 5 *2 | FIG. 5 *2 | FIG. 5 *2 | FIG. 5 *2 | FIG. 5 *2 | FIG. 5 *2 |
| Hollow | void | void | filled | void | void | void | void | void | void |
| Slot | | | | | | | | | |
| Number | 0 | 0 | 0 | 2 | 4 | 4 | 2 | 2 | 4 |
| Total length (%) | 0 | 0 | 0 | 15 | 50 | 50 | 15 | 15 | 70 |
| Depth L of Center of gravity (mm) | 35 | 40 | 38 | 45 | 46 | 48 | 40 | 40 | 48 |
| Sweet spot height H (mm) | 33 | 33 | 35 | 25 | 25 | 21 | 25 | 26 | 21 |

TABLE 1-continued

| | Ref. 1 | Ref. 2 | Ref. 3 | Ex. 1 | Ex. 2 | Ex. 3 | Ex. 4 | Ex. 5 | Ex. 6 |
|---|---|---|---|---|---|---|---|---|---|
| Test results | | | | | | | | | |
| Traveling distance (index) | 100 | 90 | 92 | 120 | 130 | 135 | 115 | 125 | 140 |
| Coefficient of restitution | 0.81 | 0.79 | 0.795 | 0.82 | 0.82 | 0.821 | 0.817 | 0.83 | 0.83 |
| Hitting sound | | | | | | | | | |
| Feeling | 5 | 2 | 2 | 5 | 5 | 5 | 5 | 5 | 5 |
| Frequency analysis (Hz) | 5000 | 3900 | 3500 | 4900 | 4920 | 4930 | 4970 | 5010 | 5020 |

*1: Ti—6Al—4V
*2: Carbon fibers "TR50S", "MR40" and "HR40

From the test results, it was confirmed that the rebound performance and traveling distance can be improved while achieving a high-pitched hitting sound.

As described above, in the golf club head according to the present invention, as the resin component is used, its saved weight can be redistributed to the metal component. The sole portion is formed of a metal material while the crown portion is formed of a resin, the center of gravity can be effectively lowered. Therefore, it becomes possible to significantly lower the center of gravity, and the depth of the center of gravity and sweet spot height may be easily optimized to improve the directional stability, traveling distance and the like. Also, it becomes possible to increase the head volume more freely than ever. As the face portion is metallic, the ball hitting sound shifts towards higher frequency when compared with the resin club face. Further, the strength and durability are increased.

The invention claimed is:

1. A hollow golf club head having a face portion whose front face defines a club face for striking a ball, a crown portion, a sole portion, a side portion between the crown portion and sole portion, and a hosel portion, and comprising a metal component made of a metal material, and a resin component made of a fiber reinforced resin, wherein said metal component comprises a face plate forming almost the entirety of the face portion, and a sole plate forming almost the entirety of the sole portion, the face plate having a width in the toe-heel direction that decreases in a direction toward a lower edge of the face plate, the sole plate having a width in the toe-heel direction that decreases in a direction toward a lower edge of the face plate, the face plate and the sole plate being connected to each other at the lower edge of the face plate along a bent line, said resin component comprises a crown plate forming the crown portion and a side plate forming the side portion, the resin component being provided with an opening for accommodating the face portion and the sole portion of the metal component and a flange formed along an edge of the opening and supporting only an edge portion of the metal component, whereby a back face of the face plate is exposed to the hollow of the head, the sole plate is gradually increased in the thickness towards the rear end thereof, whereby a maximum thickness Tr at the rear end is in a range of from 2.0 to 8.0 mm, and a minimum thickness Tf in a front end zone of the sole plate is in a range of from 1.0 to 3.0 mm, said hosel portion includes a tubular part into which a club shaft is inserted, the tubular part being integrally formed with the metal component, extending upwardly from the sole plate while leaving a space between the face plate, and being connected to the metal component only at the sole plate, and the metal component is provided along a front end of the sole plate with a continuous or discontinuous slot, and wherein the total length of the slot along the bent line between the face plate and the sole plate is in a range of not less than 5% but not more than 70% of the overall length of the bent line.

2. A hollow golf club head having a face portion whose front face defines a club face for striking a ball, a crown portion, a sole portion, a side portion between the crown portion and sole portion, and a hosel portion, and comprising a metal component made of a metal material, and a resin component made of a fiber reinforced resin, wherein said resin component comprises a crown plate forming at least a part of the crown portion, said metal component comprises a face plate forming at least a part of the face portion, and a sole plate forming at least a part of the sole portion, the face plate having a width in the toe-heel direction that decreases in a direction toward a lower edge of the face plate, the sole plate having a width in the toe-heel direction that decreases in a direction toward a lower edge of the face plate, the face plate and the sole plate being connected to each other at the lower edge of the face plate along a bent line, said resin component is provided with an opening to expose a back face of the face plate to the hollow of the head, said hosel portion includes a tubular part into which a club shaft is inserted, the tubular part being integrally formed with the metal component, extending upwardly from the sole plate and being connected to the metal component only at the sole plate, and the metal component is provided along a front end of the sole plate with a continuous or discontinuous slot, and wherein the total length of the slot along the bent line between the face plate and the sole plate is in a range of not less than 5% but not more than 70% of the overall length of the bent line.

3. A hollow golf club head having a face portion whose front face defines a club face for striking a ball, a crown portion, a sole portion, a side portion between the crown portion and sole portion, and a hosel portion, and comprising a metal component made of a metal material, and a resin component made of a fiber reinforced resin, wherein said resin component comprises a crown plate forming at least a part of the crown portion, said metal component comprises a face plate forming at least a part of the face portion, and a sole plate forming at least a part of the sole portion, the face plate having a width in the toe-heel direction that decreases in a direction toward a lower edge of the face plate, the sole plate having a width in the toe-heel direction that decreases in a direction toward a lower edge of the face plate, the face plate and the sole plate being connected to each other at the lower edge of the face plate along a bent line, said resin component is provided with an opening to expose a back face of the face plate to the hollow of the head, said hosel portion includes a tubular part into which a club shaft is inserted, and the tubular part is formed separately from the metal component and the resin component, the resin component is integrally provided with a tubular portion protruding into the hollow and forming a socket into which said tubular part of the hosel portion is inserted, and the metal component is provided along a front end of the sole plate with a continuous or discontinuous slot, and wherein the total length of the slot along the bent line between the face plate and the sole plate is in a range of not less than 5% but not more than 70% of the overall length of the bent line.

4. A hollow golf club head having a face portion whose front face defines a club face for striking a ball, a crown portion, a sole portion, a side portion between the crown portion and sole portion, and a hosel portion, and comprising a metal component made of a metal material, and a resin component made of a fiber reinforced resin, wherein said resin component comprises a crown plate forming at least a part of the crown portion, said metal component comprises a face plate forming at least a part of the face portion, and a sole plate forming at least a part of the sole portion, the face plate and the sole plate being connected to each other along a bent line, the metal component is provided along a front end of the sole plate with a single continuous slot or alternatively a plurality of slots in a single row, and wherein the total length of the slot or slots along the bent line between the face plate and the sole plate is in a range of not less than 5% but not more than 70% of the overall length of the bent line.

5. The golf club head according to claim 2, wherein the resin component further includes a side plate forming at least a part of the side portion.

6. The golf club head according to claim 2, wherein the sole plate is gradually increased in the thickness towards the rear end thereof.

7. The golf club head according to claim 1 or 2, wherein the sole plate is provided on the fringe thereof with a continuous or discontinuous rib.

8. The golf club head according to claim 2, wherein the sole plate is gradually increased in the thickness towards the rear end thereof, and the sole plate is provided on the fringe thereof with a continuous or discontinuous rib.

9. The golf club head according to claim 2 or 3, wherein the metal component further includes a continuous or discontinuous turnup wall forming a part of the side portion.

10. The golf club head according to claim 2 or 3, wherein the sole plate is gradually increased in the thickness towards the rear end thereof, and the metal component further includes a continuous or discontinuous turnup wall forming a part of the side portion.

11. The golf club head according to claim 1 or 2, wherein the depth of the center of gravity is in a range of from 40 to 55 mm.

12. The golf club head according to claim 1 or 2, wherein the sweet spot height is in a range of from 15 to 30 mm.

13. The golf club head according to claim 1 or 2, wherein the depth of the center of gravity is in a range of from 40 to 55 mm, and the sweet spot height is in a range of from 15 to 30 mm.

14. The golf club head according to claim 2, wherein the sole plate forms almost the entirety of the sole portion.

15. The golf club head according to claim 3 or 4, wherein the resin component further includes a side plate forming at least a part of the side portion.

16. The golf club head according to claim 3 or 4, wherein the sole plate is gradually increased in the thickness towards the rear end thereof.

17. The golf club head according to claim 3 or 4, wherein the sole plate is provided on the fringe thereof with a continuous or discontinuous rib.

18. The golf club head according to claim 3, wherein the sole plate is gradually increased in the thickness towards the rear end thereof, and the sole plate is provided on the fringe thereof with a continuous or discontinuous rib.

19. The golf club head according to claim 3 or 4, wherein the depth of the center of gravity is in a range of from 40 to 55 mm.

20. The golf club head according to claim 3 or 4, wherein the sweet spot height is in a range of from 15 to 30 mm.

21. The golf club head according to claim 3 or 4, wherein the depth of the center of gravity is in a range of from 40 to 55 mm, and the sweet spot height is in a range of from 15 to 30 mm.

22. The golf club head according to claim 3 or 4, wherein the sole plate forms almost the entirety of the sole portion.

* * * * *